United States Patent [19]

Barton et al.

[11] 4,023,494

[45] May 17, 1977

[54] EXPLOSIVE CONTAINER

[75] Inventors: Leslie W. Barton, Carrollton; Don H. Smith, Dallas, both of Tex.

[73] Assignee: Tyler Holding Company, Lewisville, Tex.

[22] Filed: Nov. 3, 1975

[21] Appl. No.: 628,214

[52] U.S. Cl. ..... 102/24 R; 220/304
[51] Int. Cl.[2] ..... F42B 3/00
[58] Field of Search ..... 102/24; 220/304

[56] References Cited

UNITED STATES PATENTS

| | | | |
|---|---|---|---|
| 2,819,673 | 1/1958 | Cecil et al. | 102/20 |
| 3,173,569 | 3/1965 | Craig | 220/304 |
| 3,420,173 | 1/1969 | Slawinski et al. | 102/24 |
| 3,425,589 | 2/1969 | Lipske et al. | 220/304 |
| 3,431,849 | 3/1969 | Kern et al. | 102/24 |
| 3,789,760 | 2/1974 | Griffith | 102/24 HC |
| 3,793,954 | 2/1974 | Johnston | 102/24 |
| 3,837,279 | 9/1974 | Cooke, Jr. | 102/24 |

OTHER PUBLICATIONS

*Materials in Design Engineering*, Reinhold Pub. Corp. vol. 62, No. 5, Mid-October, 1965, p. 254.

*Primary Examiner*—Verlin R. Pendegrass
*Attorney, Agent, or Firm*—Richards, Harris & Medlock

[57] ABSTRACT

A container capable of withstanding pressures having a longitudinal cord-receiving groove and a detonator-receiving groove formed as integral parts of the container. Radially projecting, substantially deformable, grooves are formed on the container at its upper and lower portions to retain a substantially non-deformable tubular sleeve positioned on the container, thereby covering the cord-receiving groove and the detonator-receiving groove. The threaded cap for the container has a projecting member which forms with the interior side walls of the cap, an annular slot for maintaining a resilient, deformable gasket. Upon threadedly engaging the cap with the threaded neck of the container the projecting member protrudes into and is adjacent the interior surface of the neck and the gasket cooperates with the edge portion of the neck to form the improved seal for the container.

7 Claims, 10 Drawing Figures

EXPLOSIVE CONTAINER

BACKGROUND OF THE INVENTION

This invention relates to a novel explosive container. In one aspect it relates to an improved cap for use with explosive containers having reinforced, hollow, threaded necks. In yet another aspect the invention relates to an explosive container capable of withstanding substantial external pressures.

In the packaging, storing, and handling of explosives, containers formed of various materials have been heretofore employed. Such containers have been formed of materials such as paper, metal, and plastics. One problem which has long faced the industry has been formation of a suitable container which could withstand substantial external pressures and yet would not detract from the desired characteristics of a container upon detonation of the explosive. Several containers have been proposed by the prior art which would allow a container to undergo variation in volume through physical or chemical changes. Normally such containers are provided with bellows disposed along the length of the container which allow axial expansion and contraction of the container. Containers having such bellow constituents are set forth in U.S. Pat. No. 3,517,616, issued June 30, 1970, to Graham D. Martin and entitled "Axially Expandable and Contractable Container"; and U.S. Pat. No. 3,420,173, issued Jan. 7, 1969, to Frank E. Slawinski and Herbert H. Whetstone, entitled "Axially Expandable and Contractable Container."

However, even with the use of bellows, problems have been encountered in constructing a container for explosives which can be adequately sealed and can withstand substantial external pressures such as those encountered when employing container in underwater operations. A need has long been felt by the explosive industry for a container which could be adequately sealed and withstand external pressure, and it is to these problems that the present invention is directed.

The present invention provides a relatiely thin walled polymeric container, suitable for explosives, which is capable of withstanding substantial external pressures. Generally stated, the explosive container of the present invention comprises:

a closed, hollow body having a reinforced, hollow, threaded neck, the body having opposed shoulders extending axially along the length thereof and defining therebetween a cord-receiving groove, and the body having a second pair of opposed shoulders extending axially along a portion of the length thereof and defining therebetween a detonator-receiving groove;

first radially projecting ridge means formed as an integral portion of the body and positioned at one end thereof;

second radially projecting ridge means formed as an integral portion of said body and positioned near the other end thereof;

tubular sleeve means positioned on the body for retaining a detonator in the detonator-receiving groove, the sleeve means being retained on the body by first and second ridge means;

threaded cap means having center projection means protruding into the neck of the container, the projection means and the interior surface of the cap means further defining an annular slot therebetween; and, a resilient, deformable gasket means positioned in the annular slot so that upon threadably engaging the cap with the threaded neck of the container the center project means protrude into and is adjacent the interior surface of the neck and the gasket means cooperates with the edge portion of the neck to form an improved seal.

In another aspect, the present invention relates to an improved cap for use with explosive containers having a hollow threaded neck which comprises:

threaded cap means;

projection means formed as an integral portion of the threaded cap means and extending downwardly from the interior surface of the cap means, the projection means and the interior surface of the cap means further defining an annular slot therebetween; and, resilient, deformable gasket means positioned within the annular slot so that upon threadably engaging the cap means with the threaded neck the projection means protrudes into and becomes adjacent the interior surface of the neck and the gasket cooperates with the edge portion of the neck to form an improved seal.

DESCRIPTION OF THE DRAWING

A more complete understanding of the invention may be had by reference to the following detailed description when taken in conjunction with the accompanying drawing wherein.

Figure 1:
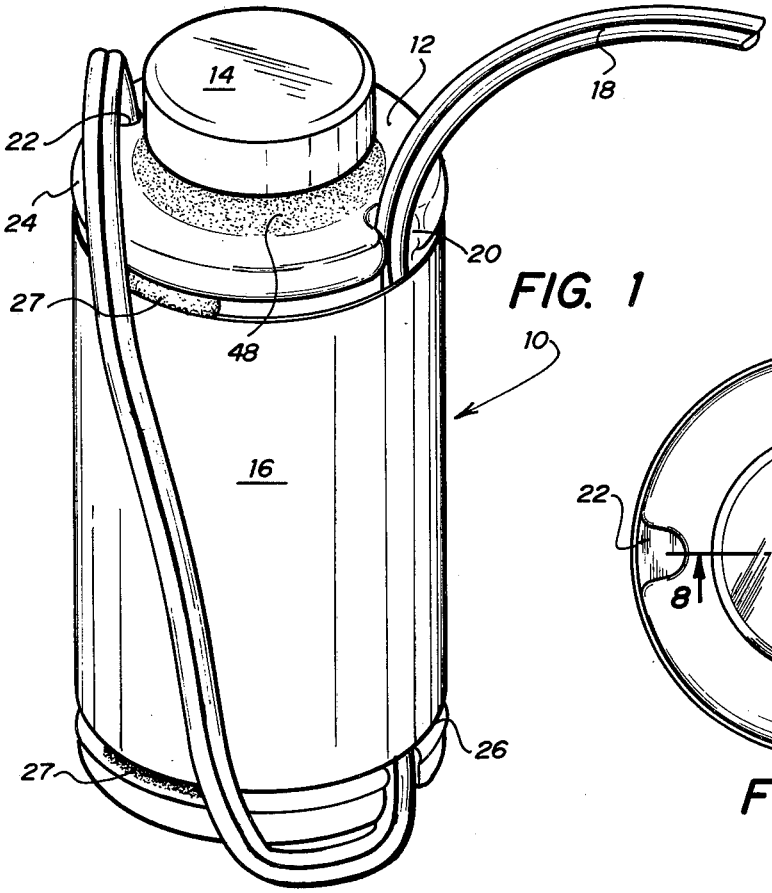
FIG. 1 is an isometric view of an armed container of the present invention.
Figure 2:
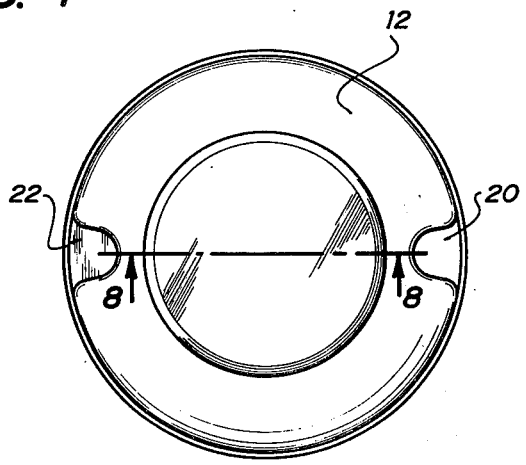
Figure 3:
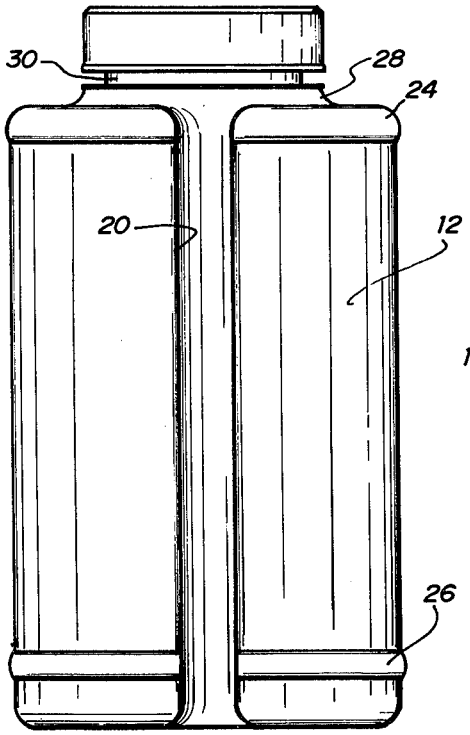
Figure 4:
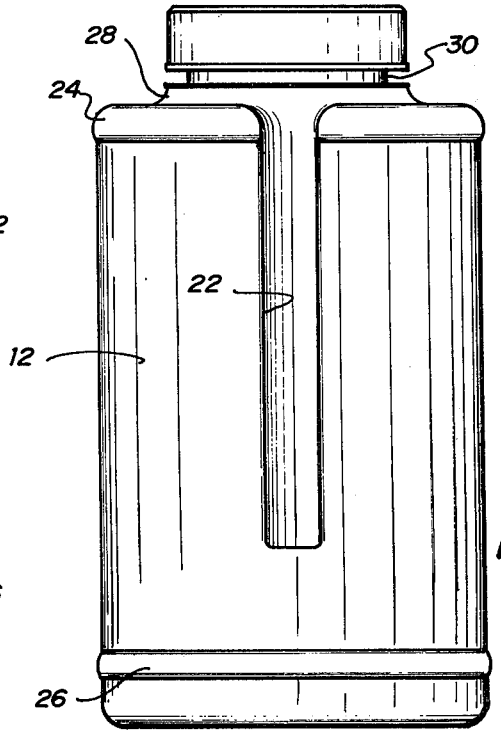
Figure 5:
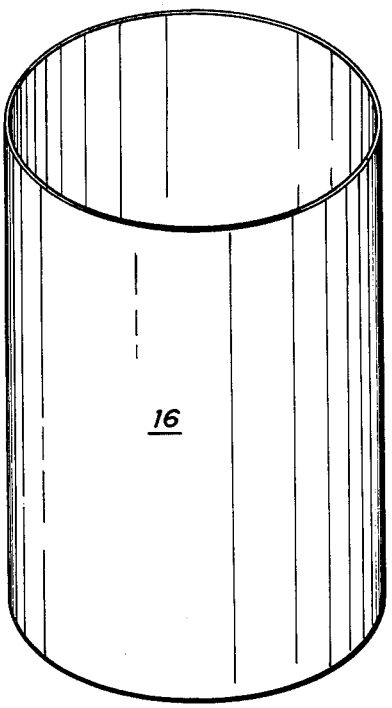
Figure 6:
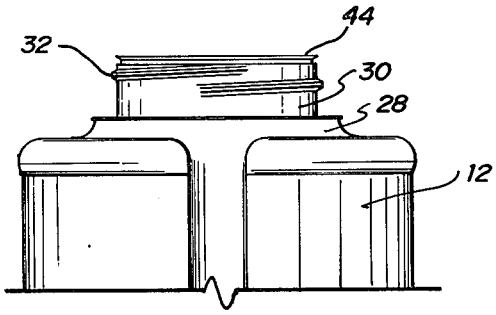
Figure 7:
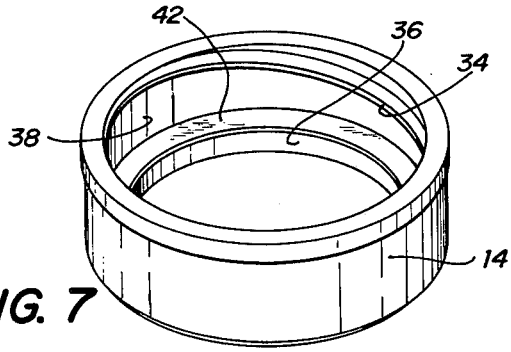
Figure 8:
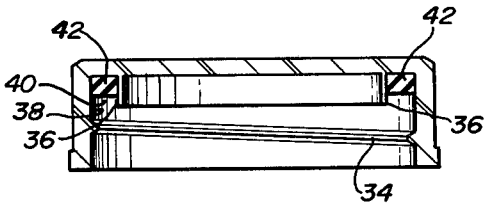
Figure 9:
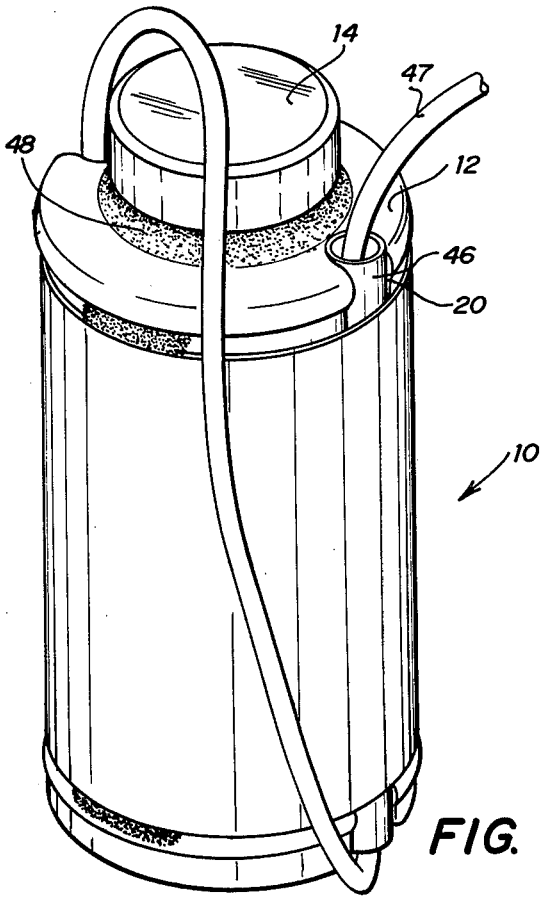
Figure 10:
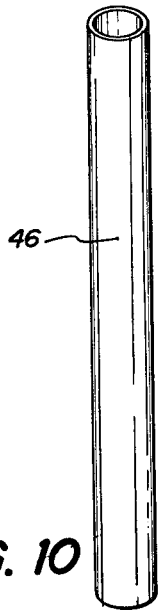

FIG.. 2 is a top view of the container of FIG. 1 except having auxiliary elements removed;

FIG. 3 is a side elevational view illustrating the container of FIG. 1 except having tubular sleeve member and auxiliary elements removed;

FIG. 4 is a side elevational view depicting the opposite side of the container of FIG. 3;

FIG. 5 is an isometric view of tubular sleeve member of FIG. 1;

FIG. 6 is a partially broken side elevational view depicting the neck means of the container of the present invention;

FIG. 7 is an isometric view depicting the cap means of the present invention;

FIG. 8 is a cross-sectional view of the cap means of FIG. 2 taken along the line 8–8;

FIG. 9 is an isometric view of another embodiment of the container of the presennt invention; and, FIG. 10 is an isometric view of the conduit member of FIG. 9.

DETAILED DESCRIPTION

Referring now to the drawings and particularly to FIG. 1 thereof, there is shown an explosive container 10 of the present invention. Container 10 comprises a closed, hollow body 12, cap member 14 secured thereto, tubular sleeve 16, and electrical cap lead wires 18 operately connected to a detonator, such as a blasting cap (not shown) secured in close proximity to body member 12 by sleeve 16. Body member 12 is provided with cord-receiving groove 20 and detonator-receiving groove 22.

Referring now to FIGS. 2, 3 and 4 in conjunction with FIG. 1, cord-receiving groove 20 and detonator-receiving groove 22 are depicted as being positioned on substantially opposite sides of body 12 of container 10.

Cord-receiving groove 20 is axially disposed along the entire length of body 12 whereas detonator-receiving groove 22 is illustrated as terminating at an intermediate position along the cylinderal surface of body 12. Cord-receiving groove 20 and detonator-receiving groove 22 may be formed as substantially U-shaped grooves which are molded during the formation of body 12 of container 10 and generally such grooves are parallel to the axis of the container. The depth of each of the grooves is generally that sufficient to receive the prescribed element while permitting sleeve 16 to be fitted thereover.

Tubular sleeve 16, see FIG. 5, is formed of a relatively non-deformable polymeric material and is held in position about body 12 of container 10 by ridge 24 disposed near the top portion of body 12 and ridge 26 disposed near the bottom portion of body 12. Ridge 24 and ridge 26 radially project from body 12 and are formed as an integral portion of body 12 during the formation of same. It should be noted that since ridges 24 and 26 are employed to retain sleeve 16 in a desired position on body 12 such are deformable to allow the sleeve to be slideably positioned thereover. When desired, tubular sleeve 16 can be further secured in place upon body 12 by the use of a sealing compound, such as sealant 27, which is applied along the edge portions of tubular sleeve 16 to seal same to body 12 at the positions substantially between cord-receiving groove 20 and detonator-receiving groove 22.

Referring now to FIG. 6, shoulder 28 is depicted as an integral member to body 12. Secured as an integral portion thereof to shoulder 28 is neck 30 having screw threads 32. It should be noted that in order to provide an explosive container for underwater seismic exploration and to provide a container which can readily withstand shock, neck 30 must be a reinforced component. We have found that such can readily be achieved if body member 12 is formed of blow molded high density polyethylene and threads 32 of neck 30 are formed of injection molded high density polyethylene.

Referring now to FIG. 7 and 8, in conjunction with FIG. 6, the improved cap 14 and the upperly extending edge portion of neck 30 will be discused to illustrate the improved seal formed between same and to illustrate the advantages obtained by such seal which allow the container to withstand shock and external pressures heretofore unavailable in the containers of the prior art. Cap 14 is provided with screw threads 34 which allow cap 14 to be threadably engaged with threads 32 of neck 30. Cap 14 is provided with a center projection ridge 36 which will protrude into neck 30 of body 12 when cap 14 is secured thereto. Center projection ridge 36 cooperates with the interior surface 38 of cap member 14 to define an annular slot 40. Gasket member 42, a resilient, deformable material such as that produced from butyl rubber and other synthetic derived rubber materials, such as polybutadiene is positioned within annular slot 40 so that when threadably engaging cap member 14 with threads 32 of neck 30, gasket member 42 cooperates with edge portion 44 of neck 30 to form an improved seal. It should further be noted that edge portion 44 of neck 32 is provided with an outwardly extending flange portion to assist in the desired sealing with gasket member 42 when the cap is securely affixed thereto.

Referring now to FIGS. 9 and 10 a second embodiment of the container of the present invention is depicted. In this embodiment tubular conduit 46 is positioned within cord-receiving groove 20 thus reducing the diameter of such groove. We have found that the use of tubular conduit 46 is especially desirable when employing the type of blasting cap device initiated by detonating cord containing less than 8 grams per foot of explosive 47 which is usually 4 grains per foot detonating cord (PETN) rather than the normal detonating cord which normally contains about 50 grains per foot. By employing tubular conduit 46 the cross-sectional area of cord-receiving groove 20 is substantially reduced so that the smaller detonating cord can be secured in place.

Referring now to FIGS. 1 and 9, and after container 10 has been fully constructed and charged with the desired explosive, it may be desirable to assist in securing cap member 14 to neck 30 of body member 12 by the use of a sealant to insure the seal is water tight under pressures encountered in subsea exploration. Such can readily be obtained by providing a seal 48 around the lower portion of cap member 14 and the upper portion of shoulder member 28. While any suitable sealant composition can be employed, especially desirable results have been obtained when the sealant is a hot melt sealant containing about 40 percent by weight ethylene vinyl acetate resin dispersed in micro crystalline wax. As previously stated, when desired to maintain sleeve members 16 on closed hollow body 12 through the use of a sealant the same composition is preferred.

In order to produce the desired container of the present invention which has been depicted in the drawings and the description with reference to the drawings, certain critical features should be noted. Closed hollow body 12 of container 10 is formed of blow molded high density polyethylene so that the side portions of the body have a thickness of about 10 to about 30 mils and the top and bottom portions of said body have a thickness of at least 40 mils. In addition, the threads of the reinforced hollow threaded neck are formed by injection molding a high density polyethylene, such precedure providing the desired reinforced neck structure. Further, we have found that it is desired that tubular sleeve 16 have a thickness of at least 40 mils.

A container having the above described specifications and of the structure set forth hereinbefore, can withstand pressures created by 50 feet of water and withstand shock produced by dropping the container, filled with a dummy charge, from a height of 25 feet. Further, the unique design of the cap member and the bottle portion of the explosive container provides an improved fluid tight seal for the explosive within the container. Thus, the explosive container and cap of the present invention incorporates numerous advantages over the prior art explosive containers.

Although preferred embodiments of the invention have been illustrated in the accompanying drawings and described in the foregoing detailed description, it will be understood that the invention is not limited to the embodiment disclosed but is capable of numerous rearrangements, modifications, and substitutions of parts and elements without departing from the spirit of the invention.

What is claimed is:

1. An explosive container comprising:

a. a blow molded plastic hollow body comprising a tubular midsection forming the sidewalls thereof; an integral bottom section enclosing the lower end of said sidewalls; an integral top section partially enclosing the upper end of said sidewalls; said top section integrally jointed to an injection molded cylindrical neck section having threads integrally molded about its outer surface, said top section and bottom section and cylindrical neck section having a greater wall thickness than said tubular midsection; and said body having a U-shaped channel disposed axially along the length thereof defining a cord receiving groove, and a U-shaped channel extending axially along a portion of the length thereof defining a detonator receiving groove;

b. first radially projecting ridge means formed as an integral portion of said body and positioned at one end thereof;

c. second radially projecting ridge means formed as an integral portion of said body and positioned near the other end thereof;

d. tubular sleeve means positioned on said body and over said cord receiving groove and said detonator receiving groove, said sleeve means being retained on said body by said first and said second ridge means;

e. a plastic cup comprising a cylindrical portion having internal threads to match said threads on the exterior of said neck section, and a top portion, said cap means having an annular protrusion centered on the inside of said top portion and extending within said cylindrical section in opposed relationship to said cylindrical portion carrying said internal threads to thereby define an annular slot therebetween said cylindrical portion of said cap being shorter in length than said neck section so that when engaged thereon a gap will result between the open end of said cylindrical portion and the top section of said blow molded plastic body for receiving a sealent composition; and f. a resilient deformable gasket positioned in said annular slot so that upon threadably engaging said cap with said neck section said annular protrusion extends into and adjacent the interior surface of said neck section and said gasket cooperates with the top portion of said neck section in sealing engagement.

2. The explosive container of claim 1 wherein said tubular sleeve is substantially nondeformable relative to said first and second ridge means such that the said ridge means deform as said annular sleeve is affixed to said tubular sidewalls.

3. The explosive container of claim 1 further comprising a plastic tubular body positioned within said cord receiving groove and held therewithin by friction fit by said tubular sleeve. .

4. An explosive charge comprising:

a. a blow molded plastic hollow body comprising a tubular midsection forming the sidewalls thereof; an integral bottom section enclosing the lower end of said sidewalls; and integral top section partially enclosing the upper end of said sidewalls; said top section integrally jointed to an injection molded cylindrical neck section having threads integrally molded about its outer surface, said top section and bottom section cylindrical neck having a greater wall thickness than said tubular midsection; and said body having a U-shaped channel disposed axially along the length thereof defining a cord receiving groove, and a U-shaped channel extending axially along a portion of the length thereof defining a detonator receiving groove;

b. first radially projecting ridge means formed as an integral portion of said body and positioned at one end thereof;

c. second radially projecting ridge means formed as a integral portion of said body and positioned near the other end thereof;

d. tubular sleeve means positioned on said body and over said cord receiving groove and said detonator receiving groove, said sleeve means being retained on said body by said first and second ridge means;

e. a plastic cap threadably engaged with said neck section comprising a cylindrical portion having internal threads to match said threads on the exterior of said neck section and a top portion, said cap means having an annular protrusion centered on the inside of said top portion and extending within said cylindrical section in opposed relationship to cylindrical portion carrying said internal threads to thereby define an annular slot therebetween said cylindrical portion of said cap being shorter in length than said neck section so that when engaged thereon a gap will result between the open end of said cylindrical portion, and the top section of said blow molded plastic body for receiving a sealant composition;

f. a resilient deformable gasket positioned in said annular slot and cooperating with the top portion of said neck in sealing engagement;

g. an explosive positioned within said container; and h. a sealant composition filling said gap around said neck section between the open end of said cylindrical portion of said cap and the top section of said blow molded plastic body.

5. The explosive charge of claim 4 wherein said tubular sleeve is substantially nondeformble relative to said first and second ridge means such that the said ridge means deform as said annular sleeve is affixed to said tubular sidewalls.

6. The explosive charge of claim 4 further comprising a plastic tubular body positioned within said cord receiving groove and held therewithin by friction fit by said tubular sleeve.

7. The explosive charge of claim 4 wherein said sealant is a hot melt sealant containing about 41 weight percent by weight ethylene vinyl acetate resin dispersed in microcrystalline wax.

* * * * *

UNITED STATES PATENT AND TRADEMARK OFFICE

CERTIFICATE OF CORRECTION

PATENT NO. : 4,023,494

DATED : May 17, 1977

INVENTOR(S) : Leslie W. Barton; Don H. Smith

It is certified that error appears in the above-identified patent and that said Letters Patent are hereby corrected as shown below:

Col. 5, line 57 (Claim 4), "and" should be --an--.

Col. 6, line 4 (Claim 4), "section cylindrical" should be --section and cylindrical--.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*